US010233661B2

(12) United States Patent
Goettl

(10) Patent No.: US 10,233,661 B2
(45) Date of Patent: Mar. 19, 2019

(54) ENERGY SAVING POOL CLEANING SYSTEM WITH PARTIAL ROTATING POOL CLEANING HEAD WITH MULTIPLE NOZZLE OPENINGS

(71) Applicant: GSG HOLDINGS, INC., Chandler, AZ (US)

(72) Inventor: John M. Goettl, Phoenix, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 0 days.

(21) Appl. No.: 15/357,979

(22) Filed: Nov. 21, 2016

(65) Prior Publication Data

US 2018/0142486 A1 May 24, 2018

(51) Int. Cl.

| | |
|---|---|
| ***B05B 1/14*** | (2006.01) |
| ***E04H 4/16*** | (2006.01) |
| ***B05B 3/02*** | (2006.01) |
| ***B05B 15/70*** | (2018.01) |
| *E04H 4/14* | (2006.01) |

(52) U.S. Cl.
CPC ..... *E04H 4/169* (2013.01); *B05B 1/14* (2013.01); *B05B 3/02* (2013.01); *B05B 15/70* (2018.02); *E04H 4/144* (2013.01)

(58) Field of Classification Search
CPC ..... E04H 4/169; E04H 4/144; B05B 1/14; B05B 3/02; B05B 15/10; B05B 1/3006
USPC ..... 4/490
See application file for complete search history.

(56) References Cited

U.S. PATENT DOCUMENTS

| | | | | |
|---|---|---|---|---|
| 935,201 | A | 9/1909 | Hallauer | |
| 1,821,579 | A | 9/1931 | Rader | |
| 1,964,269 | A | 6/1934 | Munz | |
| 2,209,961 | A | 8/1940 | De Lacy-Mulhall | |
| 2,214,852 | A | 9/1940 | De Lacy-Mulhall | |
| 2,537,904 | A | 1/1951 | McAllister | |
| 3,045,829 | A | 7/1962 | Rule et al. | |
| 3,059,243 | A | 10/1962 | Ross | |
| 3,149,784 | A * | 9/1964 | Skidgel | B05B 3/007 239/206 |
| 3,237,866 | A | 3/1966 | Lovell | |
| 3,245,420 | A | 4/1966 | Chemey | |
| 3,247,968 | A | 4/1966 | Miller | |
| 3,247,969 | A | 4/1966 | Miller | |
| 3,408,006 | A | 10/1968 | Stanwood | |
| 3,449,772 | A | 6/1969 | Werner | |
| 3,486,623 | A | 12/1969 | Bosico | |
| 3,506,489 | A | 4/1970 | Baker | |
| 3,515,351 | A | 6/1970 | Costa | |
| 3,521,304 | A | 7/1970 | Ghiz | |

(Continued)

*Primary Examiner* — Benjamin R Shaw
(74) *Attorney, Agent, or Firm* — McCarter & English, LLP

(57) ABSTRACT

Swimming pool in-floor cleaning heads may be used to variably clean a swimming pool floor by raising a nozzle head positioned on a step of the swimming pool under water and having at least first and second nozzle openings directed in different directions toward surfaces of the step, and simultaneously ejecting first and second streams of water from the first and second nozzle openings toward, respective, first and second portions of the step, variably rotating the nozzle head in a first rotational direction, retracting the nozzle head flush with an inner surface of the swimming pool, and in some cases incrementally rotating the nozzle head in a second direction, opposite the first direction.

19 Claims, 13 Drawing Sheets

(56) References Cited

U.S. PATENT DOCUMENTS 3,615,013 A 10/1971 Reece
3,675,252 A 7/1972 Ghiz
3,688,907 A 9/1972 Oravec
3,712,470 A 1/1973 Gansloser
3,765,608 A 10/1973 Lockwood
3,769,993 A 11/1973 Schaffer
3,770,203 A * 11/1973 Dyar ..... B05B 3/06 239/205
3,955,764 A 5/1976 Phaup
4,114,204 A 9/1978 Franc
4,114,206 A 9/1978 Franc
4,188,673 A 2/1980 Carter
4,193,870 A 3/1980 Goodin
4,195,371 A 4/1980 Goodin
4,200,230 A 4/1980 Gould
4,202,499 A 5/1980 Mathews
4,212,088 A 7/1980 Goettl et al.
4,271,541 A 6/1981 Mathews
4,276,163 A 6/1981 Gordon
4,322,860 A 4/1982 Gould
4,330,412 A 5/1982 Frederick
4,347,979 A 9/1982 Mathews
4,371,994 A 2/1983 Mathews
4,391,005 A 7/1983 Goettl
4,462,546 A 7/1984 Pitman
4,466,142 A 8/1984 Gould
4,471,908 A 9/1984 Hunter
4,486,907 A 12/1984 Carter
4,503,573 A 3/1985 Handzel
4,520,514 A 6/1985 Johnson
4,568,024 A 2/1986 Hunter
4,592,379 A 6/1986 Goettl
4,640,784 A 2/1987 Cant
4,832,838 A 5/1989 Stone
4,907,610 A 3/1990 Meincke
4,939,797 A 7/1990 Goettl
5,048,758 A 9/1991 Jackerson
5,107,872 A * 4/1992 Meincke ..... E04H 4/12 134/111
5,135,579 A 8/1992 Goettl
5,251,343 A * 10/1993 Goettl ..... B05B 15/10 239/204
5,265,631 A 11/1993 Goettl
5,333,788 A 8/1994 Hadar
5,826,797 A 10/1998 Kah, III
6,029,907 A 2/2000 McKenzie
6,085,995 A 7/2000 Kah, Jr. et al.
6,182,909 B1 2/2001 Kah, Jr. et al.
6,237,862 B1 5/2001 Kah, III et al.
6,301,723 B1 10/2001 Goettl
6,367,098 B1 4/2002 Barnes
6,393,629 B1 5/2002 Barnes et al.
6,419,840 B1 * 7/2002 Meincke ..... E04H 4/169 134/167 R
6,438,766 B1 * 8/2002 Capdevila Arnau .... E04H 4/169 239/205
7,708,212 B1 5/2010 Conn
7,819,338 B1 * 10/2010 Goettl ..... E04H 4/169 239/204
7,979,924 B1 * 7/2011 Goettl ..... E04H 4/169 239/236
8,533,874 B1 * 9/2013 Goettl ..... E04H 4/169 134/167 R
8,959,739 B1 2/2015 Goettl et al.
9,267,303 B1 * 2/2016 Goettl ..... E04H 4/00
2004/0194201 A1 * 10/2004 Goettl ..... E04H 4/169 4/491

* cited by examiner

ENERGY SAVING POOL CLEANING SYSTEM WITH PARTIAL ROTATING POOL CLEANING HEAD WITH MULTIPLE NOZZLE OPENINGS

BACKGROUND

1. Technical Field

Aspects of this document relate generally to cleaning nozzles for swimming pools and pool cleaning systems.

2. Background

Pool cleaning systems are used in swimming pools to remove dirt and debris from the water in the swimming pool. Various methods for removing debris from the pool include the use of "whips" extending from various location on the side walls or nozzles in the side walls or floor surface to stir up debris for pumping to the pool filter. Conventional cleaning nozzles for swimming pools utilize water pressure generated by a pool pump to direct a stream of water across a surface of the pool to entrain and move contaminants from the surface toward a drain. Many conventional cleaning nozzles "pop up" from a surface of a pool as the heads, normally level with the surface, are extended under the influence of water pressure from the pump. When the water pressure from the pump ends, the heads retract downward until level with the surface, conventionally in response to bias from a spring element contained within the cleaning nozzle.

Pump operating time (and thus power usage) has become a very important factor in pool operation. Conventional methods for cleaning steps, slopes and other areas within a pool use full rotation cleaning nozzles to effect specially shaped areas such as steps and alcoves, resulting in more nozzles being used and subsequent larger pump sizing. One example of this is that for cleaning steps that present an area 12 inches wide and 8 feet long, a typical configuration would be to place a conventional cleaning head with a cleaning range of four or more feet that steps 18 times to cover the area. This takes approximately 18 to 20 minutes of pump time and about half of the output of a 1 horsepower pump.

SUMMARY

According to one aspect of the disclosure, a method of cleaning steps of a swimming pool may comprise intermittently raising a nozzle head positioned on a step of the swimming pool under water, the nozzle head comprising at least a first nozzle opening and a second nozzle opening directed in different first and second nozzle directions toward a surface of the step, and simultaneously ejecting a first stream of water from the first nozzle opening toward a first portion of the step and a second stream of water from the second nozzle opening toward a second portion of the step different from the first portion, incrementally rotating the nozzle head in a first rotational direction, retracting the nozzle head flush with an inner surface of the swimming pool, and incrementally rotating the nozzle head in a second rotational direction, opposite the first rotational direction, after the nozzle head rotates a predetermined number of incremental rotations in the first rotational direction and at least 45 degrees but not more than 180 degrees.

Particular embodiments may comprise one or more of the following features. The step may comprise a longer portion and a shorter portion, and wherein the first nozzle direction may be directed toward the longer portion and the second nozzle direction may be directed toward the shorter portion. The first nozzle direction and the second nozzle direction may be at least 90 degrees different from each other. The nozzle head may incrementally rotate between 13 to 15 times in the first rotational direction prior to incrementally rotating in the second rotational direction. The nozzle head may further comprise a third nozzle opening directed in a third direction, different from the first direction and the second direction by at least 90 degrees, wherein the nozzle head incrementally rotates between 3 to 6 times in the first rotational direction prior to incrementally rotating in the second rotational direction. The nozzle head may further comprise a third nozzle opening directed in a third direction, different from the first direction and the second direction by at least 90 degrees, and at fourth nozzle opening directed in a fourth direction, different from the first direction, and the second direction and the third direction by at least 90 degrees each, wherein the nozzle head incrementally rotates between 3 to 6 times in the first rotational direction prior to incrementally rotating in the second rotational direction. The nozzle head may incrementally rotate between 8 to 10 times in the first rotational direction prior to incrementally rotating in the second rotational direction.

According to another aspect of the disclosure, a method of cleaning a swimming pool may comprise aiming an adjustable swimming pool cleaning nozzle head in a swimming pool with at least a first large nozzle opening facing in a first direction and at least a first small nozzle, smaller than the first large nozzle, facing in a second direction different from the first direction, raising the nozzle head under water in the swimming pool and simultaneously ejecting at least a first large stream of water in the first direction from the first nozzle opening and at least a first small stream of water, smaller than the first large stream of water, from the first small nozzle opening, rotating the nozzle head in a first rotational direction, and spraying the first large stream of water toward a first large area of a swimming pool and simultaneously spraying the first small stream of water toward a first small area of the swimming pool.

Particular embodiments may comprise one or more of the following features. The first large area of the swimming pool may be along a width of a pool step and the first small area of the swimming pool may be along a depth of the pool step. Simultaneously ejecting at least a second large stream of water in a third direction from a third nozzle opening in the nozzle head, the third direction different from the first direction and the second direction. Simultaneously ejecting at least a second small stream of water in a fourth direction from a fourth nozzle opening in the nozzle head, the fourth direction different from the first direction, the second direction and the third direction. The first direction, the second direction, the third direction and the fourth direction may be each 90 degrees different from each other. The first direction and the third direction may be 180 degrees different from each other and the first direction and the second direction may be 90 degrees different from each other. The first direction and the second direction may be 90 degrees different from each other. The first direction and the second direction may be 180 degrees different from each other.

According to yet another aspect of the disclosure, a method of cleaning a swimming pool may comprise intermittently raising a nozzle head under water, the nozzle head comprising at least a first nozzle opening and a second nozzle opening directed in different first and second directions, and simultaneously ejecting a first stream of water outward from the first nozzle opening and a second stream of water outward from the second nozzle opening, incrementally rotating the nozzle head in a first direction, retracting the nozzle head flush with an inner surface of the swimming pool, and incrementally rotating the nozzle head in a second rotational direction, opposite the first rotational direction, for a predetermined number of incremental rotations, after the nozzle head rotates the predetermined number of incremental rotations in the first rotational direction.

Particular embodiments may comprise one or more of the following features. The first and second directions may be at least 90 degrees different from each other and the method may further comprise incrementally rotating the nozzle head between 3 to 15 incremental rotations in the first rotational direction prior to incrementally rotating the nozzle head between 3 to 15 incremental rotations in the second rotational direction. The nozzle head may further comprise at least a third nozzle opening directed in a third direction different from the first and second directions by at least 90 degrees, and the method may further comprise simultaneously ejecting a third stream of water from the third nozzle opening while the first and second stream of water are being ejected, and incrementally rotating the nozzle head between 3 to 10 incremental rotations in the first rotational direction prior to incrementally rotating the nozzle head between 3 to 10 incremental rotations in the second rotational direction. The nozzle head may further comprise at least a fourth nozzle opening directed in a fourth direction different from each of the first, second and third directions by at least 90 degrees, and the method may further comprise simultaneously ejecting a fourth stream of water from the fourth nozzle opening while the first, second and third streams of water are being ejected, and incrementally rotating the nozzle head between 3 to 6 incremental rotations in the first rotational direction prior to incrementally rotating the nozzle head between 3 to 6 incremental rotations in the second rotational direction. The first and third nozzle openings may be larger in diameter than the second and forth nozzle openings. The first direction and the second direction may be between 45 degrees and 180 degrees different from each other.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § 112, ¶6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112, ¶6. Moreover, even if the provisions of 35 U.S.C. § 112, ¶6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended nozzle assembly, assembly procedures for a nozzle assembly and/or will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such nozzle assemblies and implementing components, consistent with the intended operation.

Figure 1B:
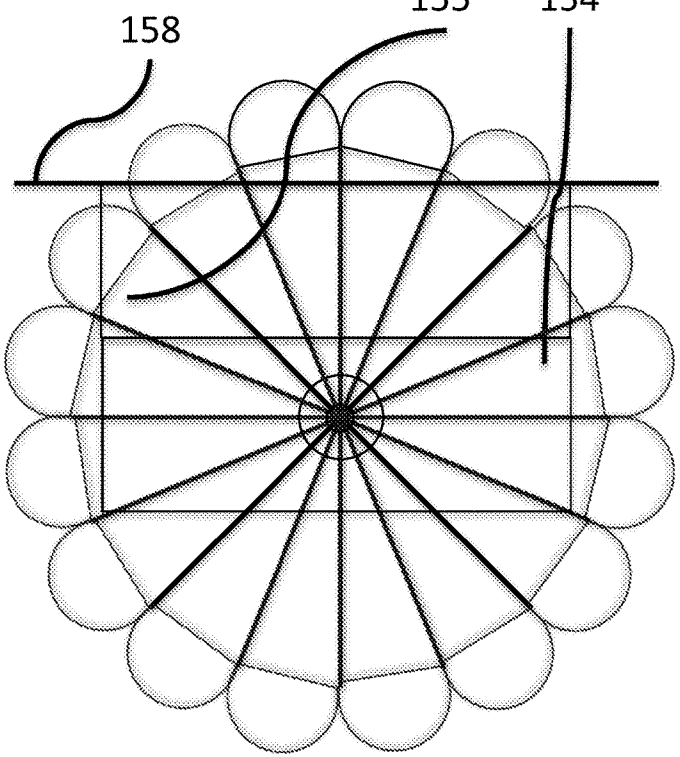
FIG. 1B (prior art)
FIG. 1B is a representation of the swimming pool cleaning head of FIG. 1A positioned on a swimming pool step.
Figure 1A:
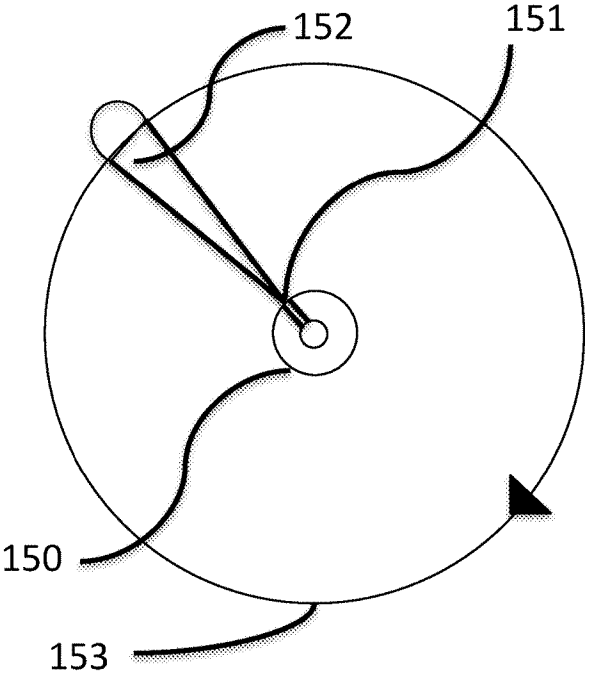
FIG. 1A (prior art)
FIG. 1A is a representation of a spray pattern of a swimming pool cleaning head that cleans 360 degrees.

When a pool cleaning head nozzle sprays, the magnitude of the spray is determined by many factors in the cleaning circuit and nozzle head, but generally provides consistent spray pressure throughout its rotation. FIGS. 1A-1B illustrate a cleaning head nozzle spray pattern for a prior art 360 rotating swimming pool cleaning head nozzle. FIG. 1A represents a cleaning head 150 with a nozzle 151 ejecting a spray 152. The outer ring 153 with its directional arrow represents that the cleaning head rotates and sprays a full 360 degrees. FIG. 1B represents the spray pattern for the cleaning head of FIG. 1A where the cleaning head is implemented as an incrementally rotating cleaning head and remains in one position spraying water for a predetermined period of time determined by the control circuit for the swimming pool pump prior to the retracting until the next time the circuit provides pressurized water to the cleaning nozzle 151. For the example provided in FIG. 1B, there are 16 cycle positions and each cycle typically runs for 1 minute so that it takes 16 minutes of run time to rotate 360 degrees with each rotational position being an equal 22.5 degrees apart. FIG. 1B further illustrates a swimming pool wall 158 and swimming pool steps 154, 155. Because the lower swimming pool step 154, that the pool cleaning head is on is lower than the top swimming pool step 155, the portions of nozzle spray that spray toward the top swimming pool step 155, spray against the wall of the top swimming pool step 155 rather than continuing out to their full distance as they would do without the top swimming pool step 155 in place.

Figure 1C:
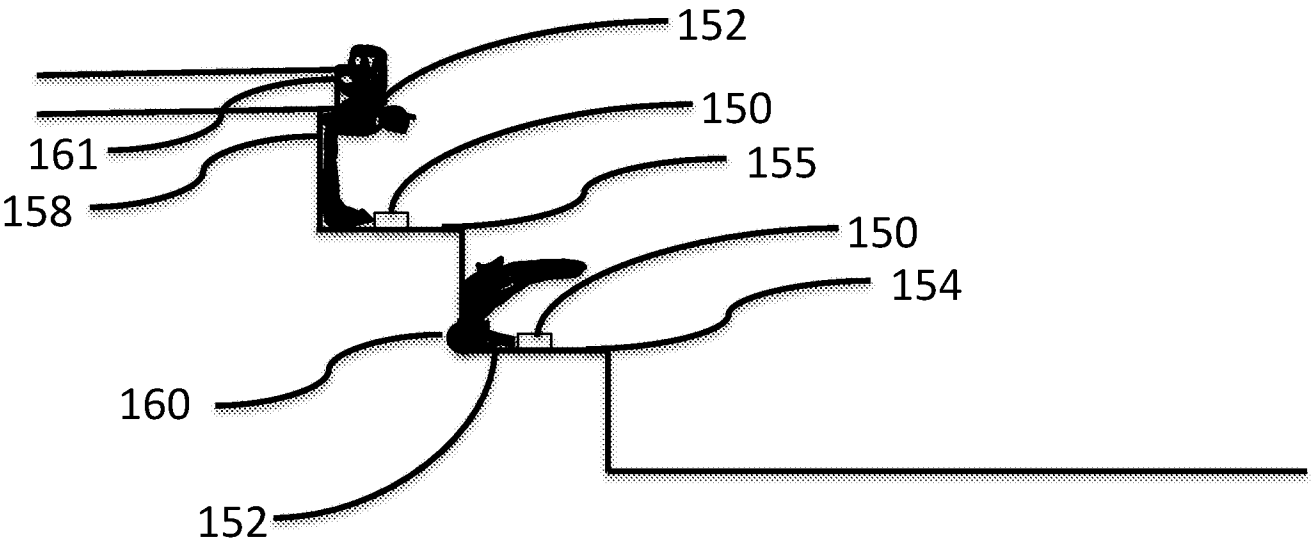
FIG. 1C (prior art)
FIG. 1C is a side view of the swimming pool and steps of FIG. 1B illustrating water spray effects.

FIG. 1C represents a side-view of the swimming pool example of FIG. 1B, to illustrate some of the problems that occur when the floor cleaning heads spray water 152 against the surfaces of the pool with too much pressure too often. Note that for the water on the top step 155 of the pool, the water reflects off of the back wall 158 of the step and may boil up above the water level of the pool to contact the decorative tile 161 around the edge of the pool and the decking. Over time, this erodes the finish on both and causes the pool to prematurely deteriorate. For the any of the pool steps 154, 155, as illustrated by the erosion 160 at the second step of the pool, when the cleaning nozzle sprays against the wall 158 of the pool in one place with too much force, or with lesser force over time, the cleaning nozzle may prematurely erode 160 the plaster on the pool surface.

Figure 1E:
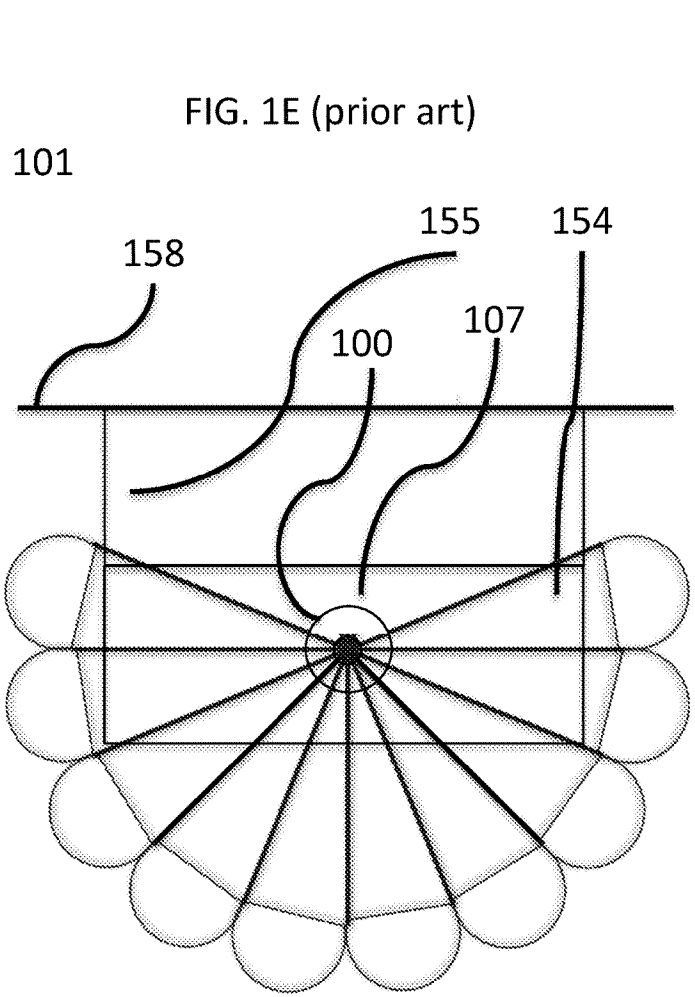
FIG. 1E (prior art)
FIG. 1E is a representation of the swimming pool cleaning head of FIG. 1D positioned on a swimming pool step.
Figure 1D:
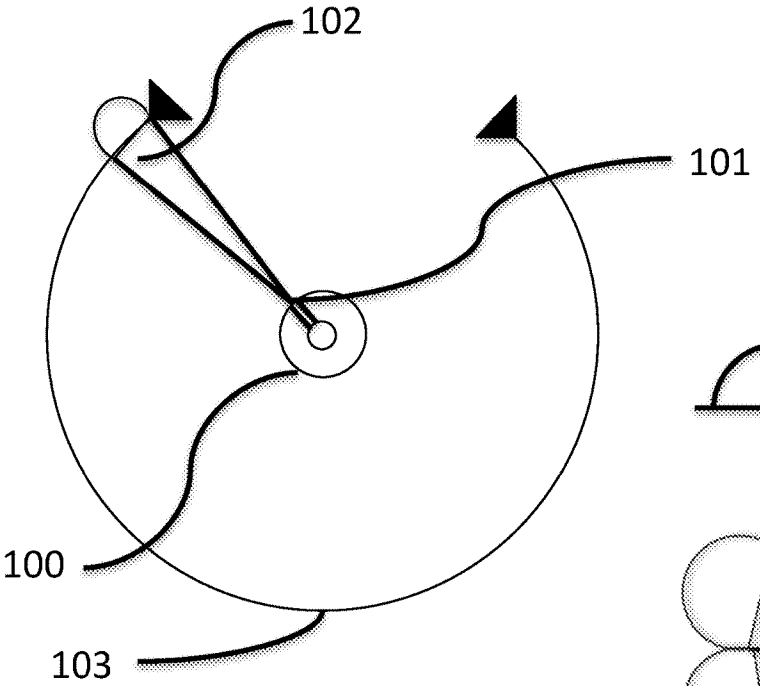
FIG. 1D (prior art)
FIG. 1D is a representation of a spray pattern of a swimming pool cleaning head that cleans less than 360 degrees.

To avoid the undesired spray pressure against the stair and close-wall surfaces, a partially rotating cleaning head may be used. FIG. 1D represents, similar to FIG. 1A, the cleaning spray pattern of a partially rotating cleaning head 100 with a spray nozzle 101 that emits a spray pattern 102 that rotates only a portion 103 of the 360 rotation and then reverses its direction to move back toward the first direction. FIG. 1E illustrates, like FIG. 1B, the respective spray pattern for an incrementally rotating cleaning head but in this case the cleaning head has 10 positions, each 22.5 degrees apart providing a total of 225 degrees of rotation. A downside to this configuration, however, is that a dead space 107 now exists between the cleaning head 100 and the wall where dirt and debris collects. This is also undesirable.

Figure 2A:
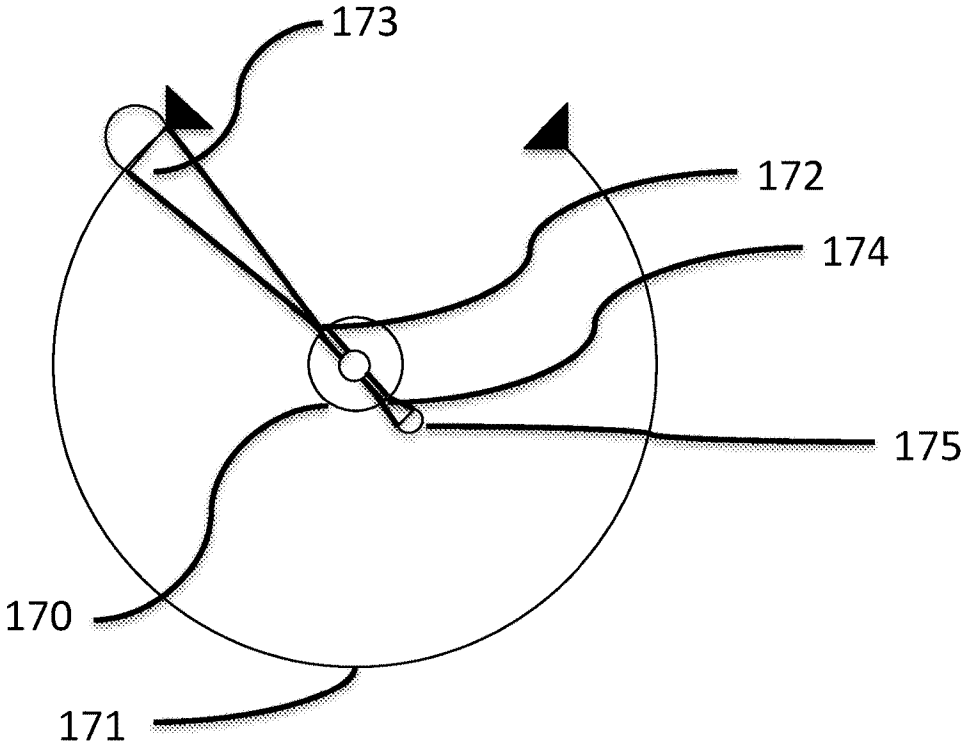
FIG. 2A is a representation of a spray pattern of a variable rotating swimming pool cleaning head that includes multiple spray nozzle openings.
Figure 2C:
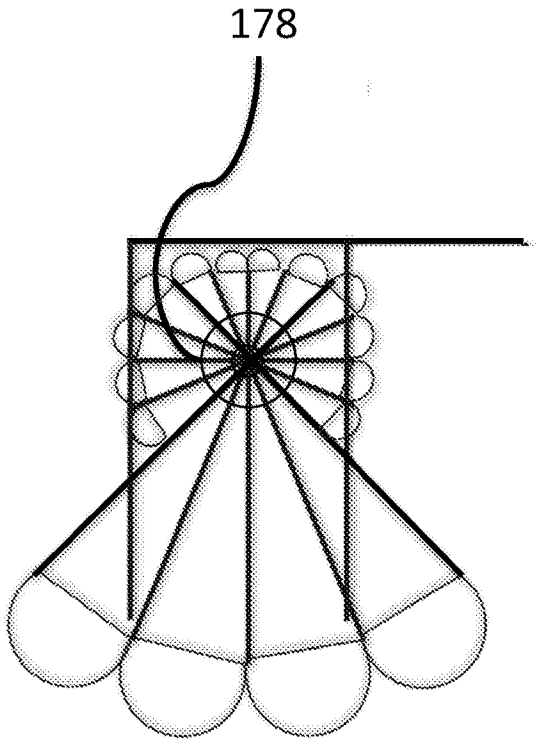
FIG. 2C is a representation of a swimming pool cleaning head with three small nozzle openings and one large nozzle opening.
Figure 2B:
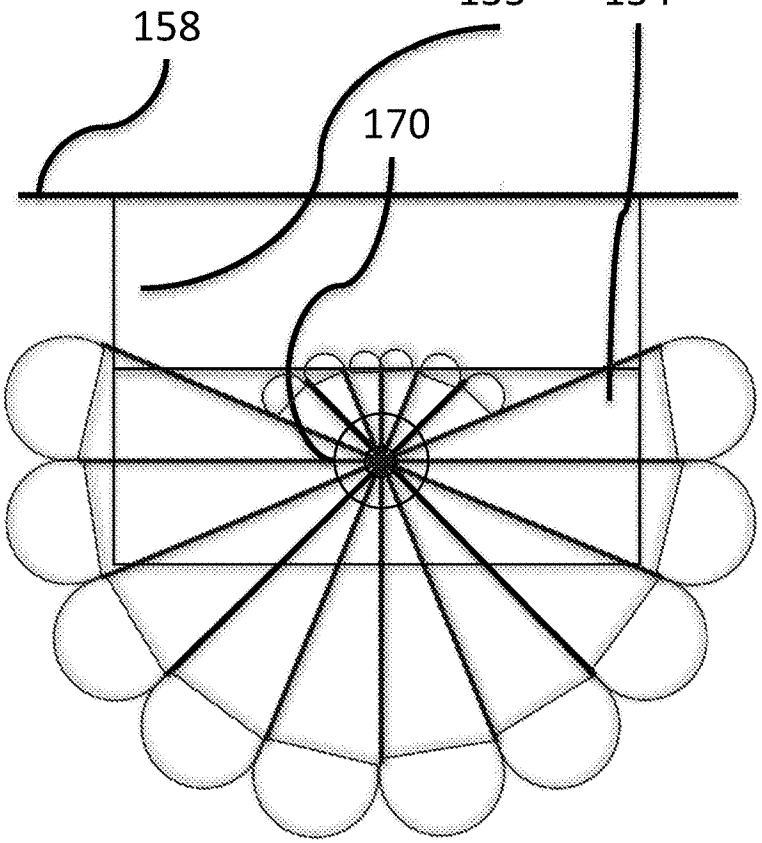
FIG. 2B is a representation of the swimming pool cleaning head of FIG. 2A positioned on a swimming pool step.

FIGS. 2A-2B represent a spray pattern of a cleaning head of the present disclosure with a plurality of cleaning head nozzle openings 172, 174 on different sides of the cleaning head 170. As shown, the larger nozzle opening 172 that results in a larger spray pattern 173 is shown with a longer spray pattern and its total rotation pattern 176 is represented by the rotation pattern 176 line with opposing arrows on its end indicating that this cleaning head reverses its direction at the end of its rotation. As will be noted for this particular example, when the larger nozzle opening 172 makes its rotation pattern 171, the smaller nozzle opening 174 is making its rotation 180 degrees opposite of the larger nozzle opening 172. As a result, as shown in FIG. 2B by the smaller spray pattern lines 175, the spray pattern of the smaller nozzle opening 174 cleans the previously considered dead spot behind the cleaning head without the larger nozzle opening's spray undesirably spraying against the wall of the pool (or in this case, more specifically, the wall of the step).

FIG. 2C, similar to FIG. 2B, represents a cleaning head nozzle spray pattern, but in this case the nozzle 178 is configured with one larger nozzle opening, generating four positions of spray, and three smaller nozzle openings, each generating four positions of spray for a total of twelve positions among them, in the same cleaning head, and is illustrated as if positioned on a corner of a swimming pool step, an area known to be difficult to clean in the pool industry. For this embodiment, the larger nozzle opening is aimed to spray along the width of the swimming pool step for its four 22.5 degree stepped rotations prior to reversing direction. As a result, each of the three smaller nozzle openings that are, for this representative example, spaced 90 degrees apart, similarly spray four 22.5 degree stepped rotations and clean the remainder of the step. On a typical pool cleaning cycle, the corner of the step is cleaned only four one minute cycles (4 minutes).

Figure 3A:
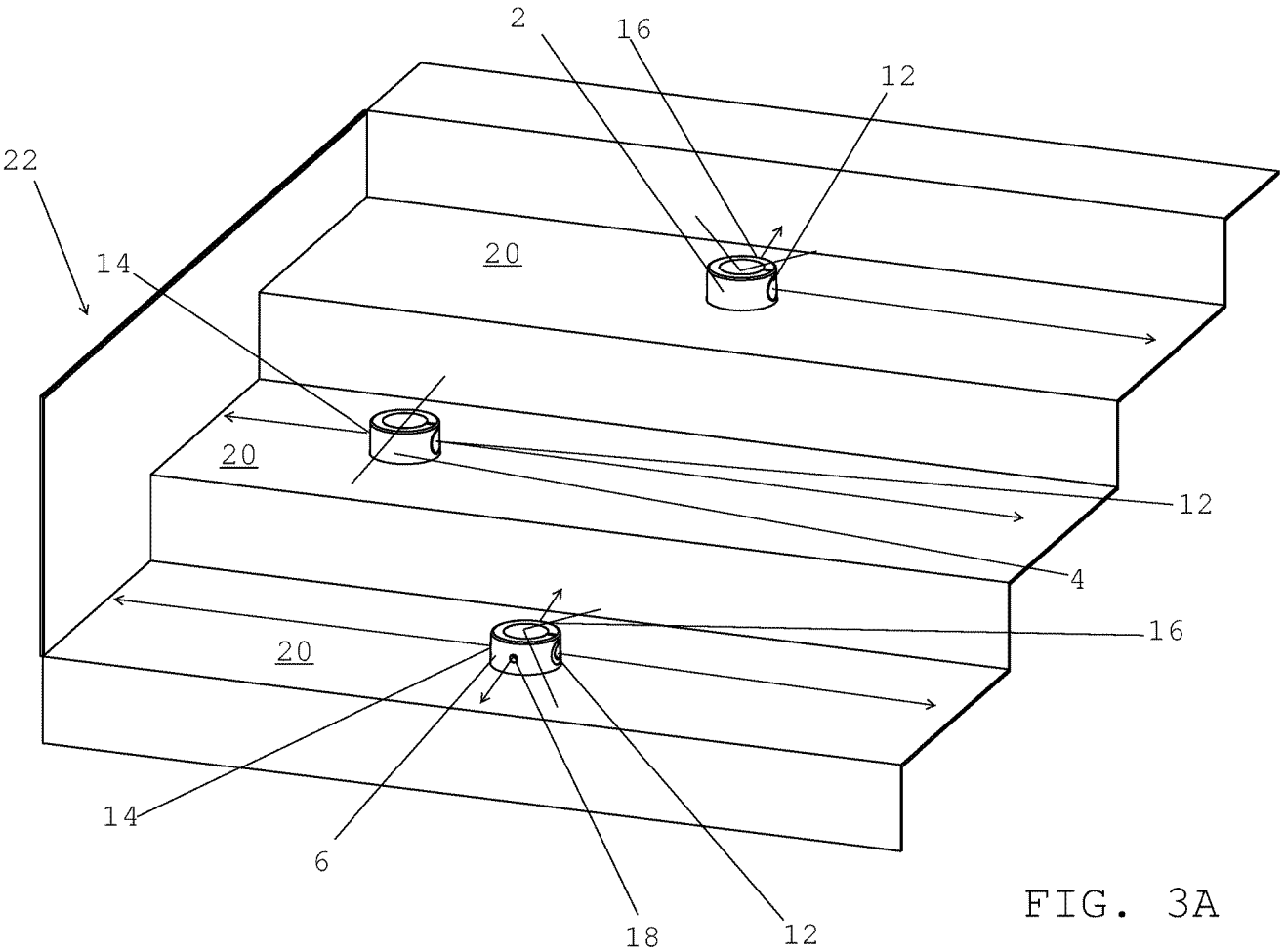
FIG. 3A is a front perspective view of a plurality of swimming pool cleaning heads raised on stairs of a swimming pool floor.
Figure 3B:
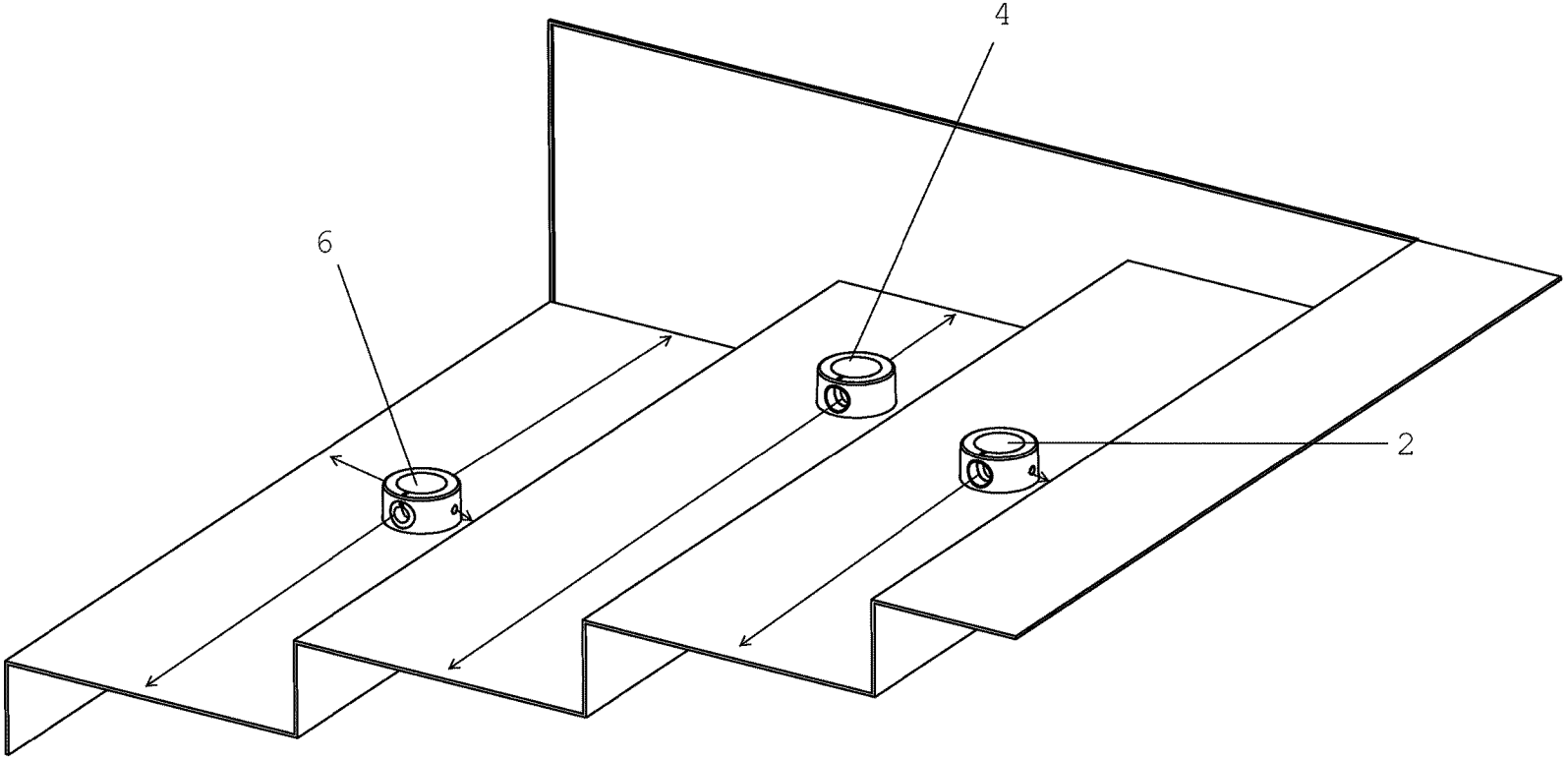
FIG. 3B is a back perspective view of a plurality of swimming pool cleaning heads raised on stairs of a swimming pool floor.

FIGS. 3A and 3B illustrate, respectively, front and rear perspective views of stairs or other pool surface 20 of a swimming pool 22 with three different examples of swimming pool in-floor cleaning or nozzle heads 2, 4, 6, that are configured to rotate such that their major, or larger, nozzles spray only along selected portions of the swimming pool floor and either reverse directions to remain within the selected portions of the swimming pool floor or skip over portions of their respective rotations to maintain the major nozzles spraying only in the selected portions of the swimming pool floor.

In some embodiments, the nozzle heads 2, 4, 6 are configured to rotate only a portion of a full 360 degrees and each have multiple nozzle openings 12, 14, 16, 18 in the respective heads 2, 4, 6. U.S. Pat. No. 9,267,303 to Goettl, issued Feb. 23, 2016, the disclosure of which is hereby incorporated herein by this reference, discloses several structures and methods for in-floor swimming pool cleaning heads. Any of these structures or methods for in-floor swimming pool cleaning heads, or others that are now or become known to those in the art for enabling a swimming pool cleaning head to rotate only a portion of 360 degrees before reversing or resetting may be used with the methods disclosed herein. Those of ordinary skill in the art will readily understand how to adapt such cleaning heads to the methods disclosed herein from this disclosure.

To clean 360 degrees around a cleaning head, conventional pop-up cleaning heads are required to rotate a full 360 degrees. Only recently, pop-up heads have been made to rotate only a portion of the 360 degrees and then reverse, but this was only used where it was not desirable to clean an angular portion of the pool floor within the 360 degrees around the cleaning head. In cleaning the pool floor within the 360 degree area around the cleaning head, cleaning heads have conventionally been made with 18 steps of rotation to complete the full 360 degree rotation.

By adding additional cleaning nozzle openings in select nozzle cleaning heads, the nozzle head is not required to complete the full 18 steps of cleaning and can complete a full 360 degrees of cleaning in much fewer steps of cleaning. Fewer steps of cleaning means fewer cycles of the cleaning pump and, thus, less pump operation time.

In some embodiments, the nozzle heads 2, 4, 6 are configured to rotate to a point around the 360 degrees and then skip a portion of the rotation so that a portion of the pool surface is not sprayed by one or more of the nozzles. For example, nozzle head 2 may be configured such that the major nozzle opening 12 sprays along the wide portions of the step and the front of the step, but then skips the 90 to 180 degrees of the rotation when the nozzle is angled closest to a wall or depth of a step. U.S. Pat. No. 7,708,212 to Conn, issued May 4, 2010, the disclosure of which is hereby incorporated herein by this reference, discloses several structures and methods for in-floor swimming pool cleaning heads. Any of these structures or methods for in-floor swimming pool cleaning heads, or others that are now or become known to those in the art for enabling a swimming pool cleaning head to rotate completely, but skips over a portion of 360 degrees on each complete rotation, such as by making large rotational steps at the critical portion of the rotation, may be used with the methods disclosed herein. Those of ordinary skill in the art will readily understand how to adapt such cleaning heads to the methods disclosed herein from this disclosure.

For either type of cleaning head, whether it rotates a portion of 360 degrees and then reverses directions, or continues rotating in the same direction but skips over a portion of the 360 degrees quickly (collectively "variable rotating" cleaning heads), the spray nozzle may be configured such that it incrementally pops-up and sprays in one direction for a period of time, such as a minute, and then retracts and changes position, or such that it continuously rotates in one direction while spraying for a period of time. The principles discussed in this disclosure applies to any of these combinations of swimming pool in-floor cleaning heads. Although the particular internal structure of the embodiments of FIGS. 3-6 show incrementally rotating cleaning head structure, the principles described herein apply equally to all variable rotating cleaning heads.

Figure 4A:
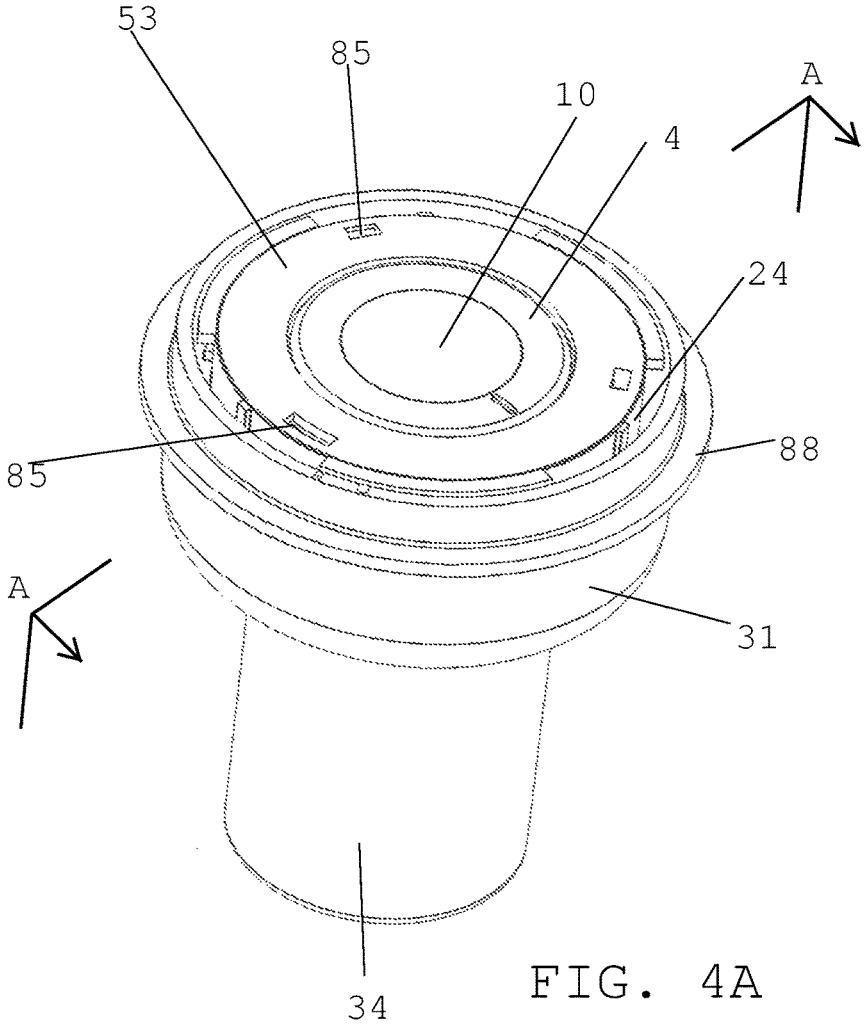
FIG. 4A is perspective view of a pool cleaning head assembly.
Figure 4B:
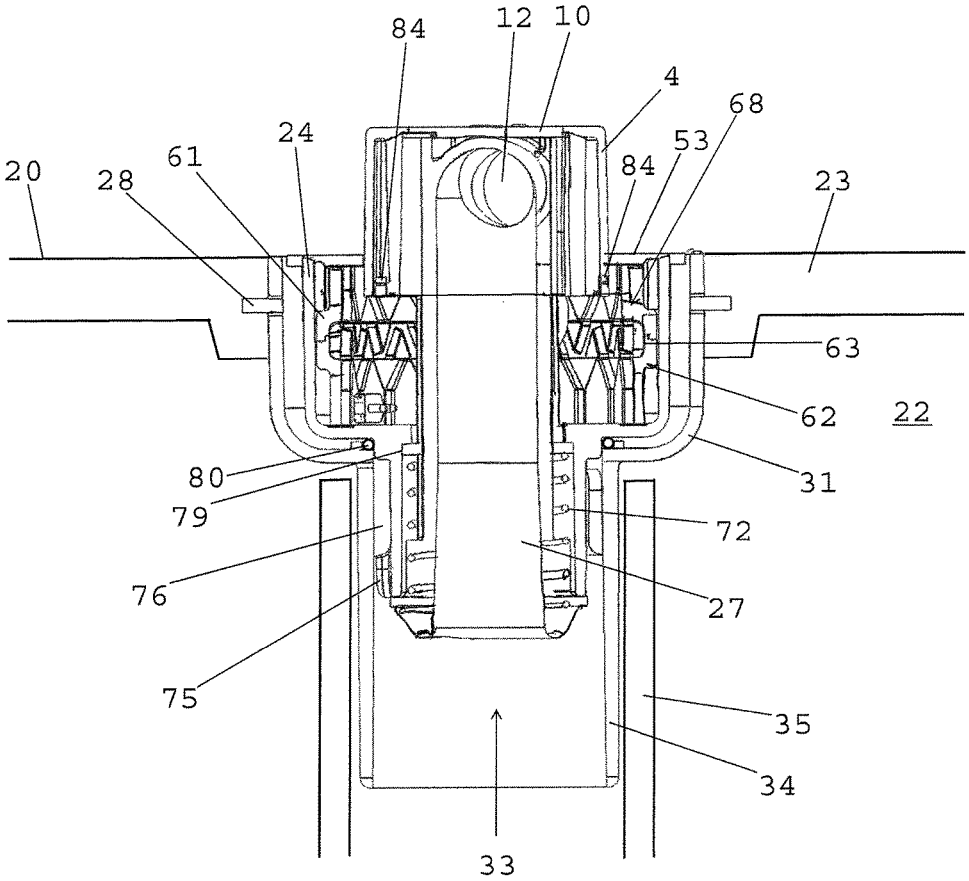
FIG. 4B is a cross-sectional view of the cleaning head assembly of FIG. 4A along line A-A with the pool cleaning head assembly being embedded in a pool surface.

FIGS. 3-4 depict a basis of a cleaning head assembly. According to various aspects, the cleaning head assembly may comprise a variable rotating cleaning head assembly. In particular, FIG. 4A depicts a perspective view of a cleaning head assembly with the nozzle head 4 in a in a retracted position, and FIG. 4B depicts a side view of a cleaning head assembly with the nozzle head 4 in an extended, operating position. In the retracted position, the upper surface of the cleaning head assembly is substantially flush with the adjacent swimming pool surface 20 (see FIG. 4B), or at least with a surface of a housing for the cleaning head assembly. The cleaning head assembly comprises a body 31 comprising a hollow cylinder 34 for coupling to the interior of a plumbing pipe 35 (see FIG. 4B) periodically supplying water under pressure to the cleaning head assembly. The body 31 typically further comprises a diametrically enlarged section coupled to the cylinder 34. A cap ring 3 may also be provided to finish flush with top of the body 31, a top of a retainer 4, a top of the nozzle head 4 when the nozzle head 4 is retracted, and/or the swimming pool surface 17.

In one or more embodiments, the cleaning head assembly comprises a nozzle removal flange 6 that is either coupled to or integral with the retainer 4 (also referred to as a housing or a cam housing). The nozzle removal flange is configured to provide coupling of a removal tool (not shown) in the typical manner. The cap ring 3 may further comprise one or more aiming tool ports 5 that are configured to receive a ring removal tool for operation of the cap ring 3. To ensure that the cleaning head nozzles openings are aimed in the correct direction in relation to a swimming pool surface, when the cleaning head nozzle is installed into the swimming pool surface, it is aimed so that the appropriately sized nozzles will clean the corresponding portions of the swimming pool surface. A nozzle removal tool recess 7 is also formed between the retainer 4 and the body 31 in one or more embodiments. The nozzle removal tool recesses are sized or otherwise configured to a receive nozzle removal tool in the conventional manner such that the retainer 4, stem 11, cam assembly 18 and nozzle head 4 are removable from the body embedded into the pool surface 17. Various embodiments of the nozzle head 4 further comprise a plate 10 coupled to the top of the nozzle head 4 and/or a nozzle direction indicator 9 that points the direction of water flow out of the nozzle head 4. The nozzle removal tool recess 7 allows for removal and replacement of the cleaning heads due to damage or to replace the cleaning head with a different nozzle configuration if needed for a particular cleaning head circuit layout within a swimming pool.

Figure 5:
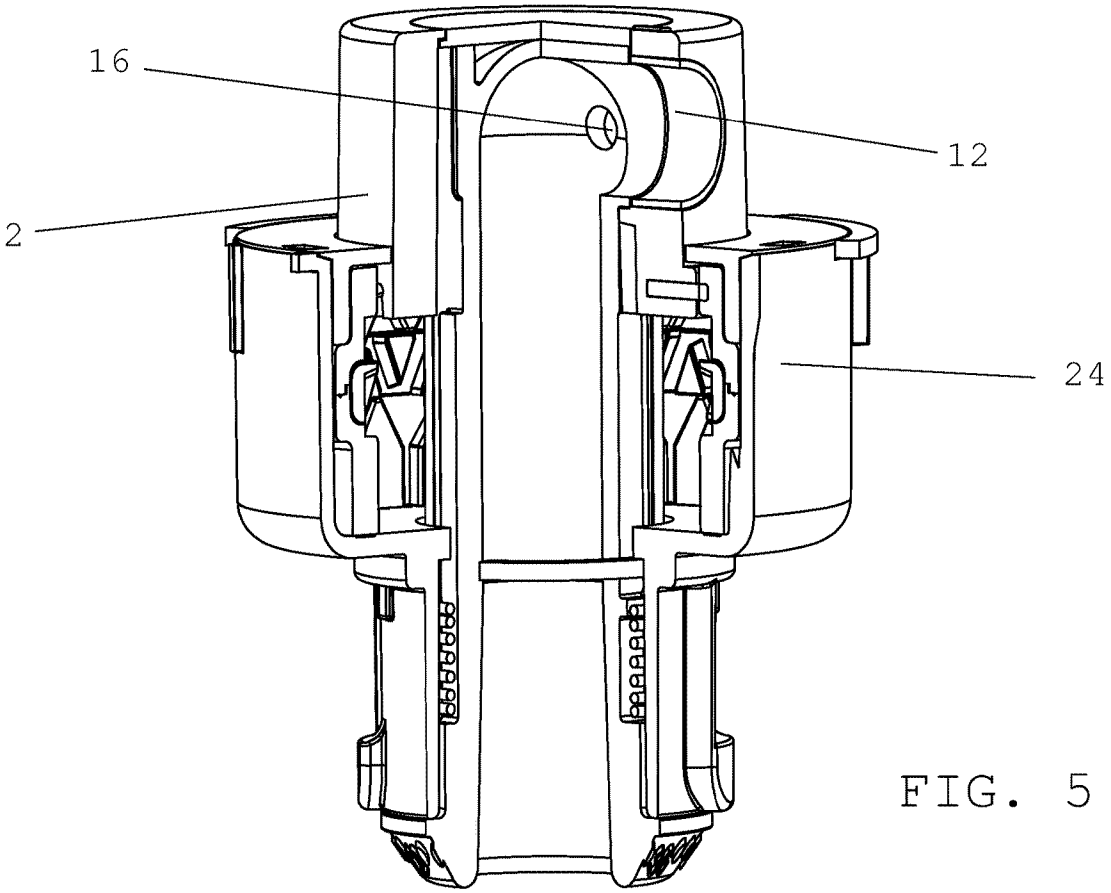
FIG. 5 is a perspective view of a swimming pool cleaning head with two nozzle apertures and the front quarter of the nozzle removed for convenience of illustration.
Figure 6:
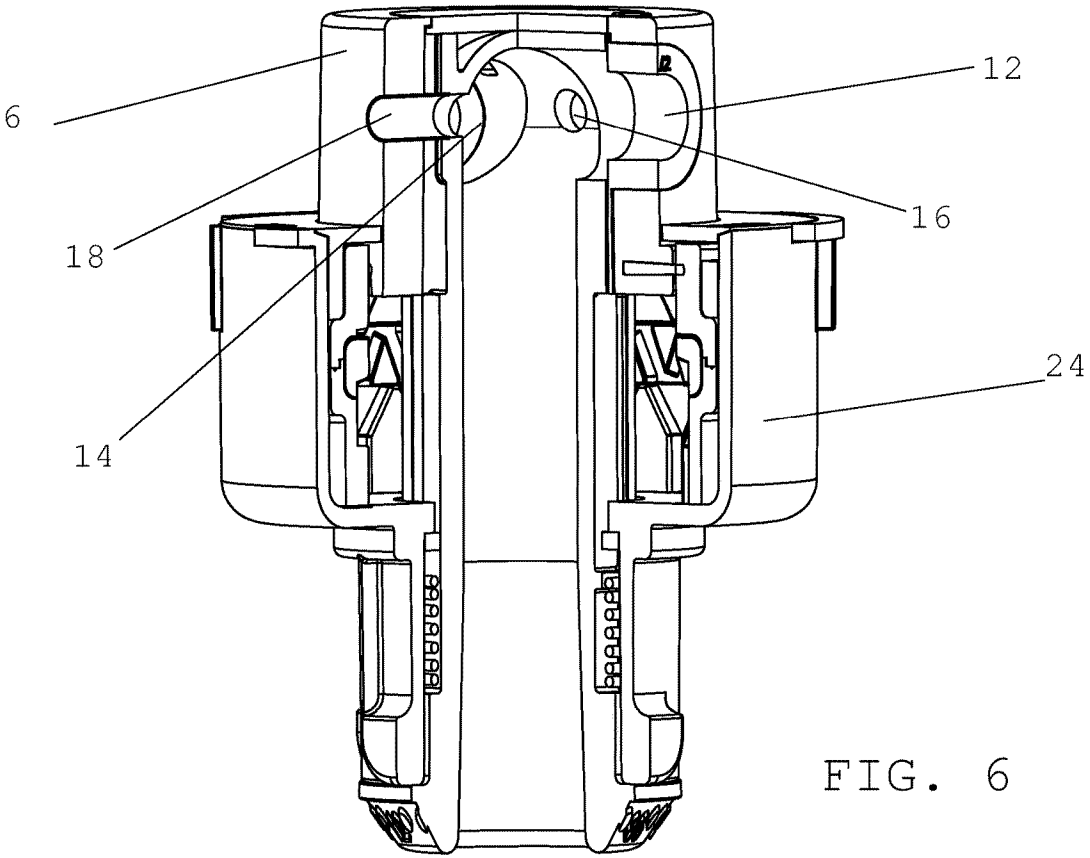
FIG. 6 is a perspective view of a swimming pool cleaning head with four nozzle apertures and the front quarter of the nozzle removed for convenience of illustration.

With specific reference to FIG. 4B, a cross-sectional view along lines A-A of the embodiment of FIG. 4A is depicted, with the nozzle head 4 in an extended position. The body 31 is configured to sealably fit in plumbing pipe 35 in the usual manner. More particularly, the cylinder 34 of the body 31 typically couples within or without the plumbing pipe 35 as is understood in the art. The body 31 is typically further configured to embed in a pool structure 22 and interior finish 23 in the conventional manner. However, while installation in a typical concrete pool is shown in FIG. 4B, it is also contemplated that the body 31 could be and is adapted to be installed in any type of pool structure such as but not limited fiberglass, vinyl, steel and the like. As shown in FIG. 4B, the retainer 24 typically finishes flush with the interior pool surface 20 and the top of the body 31. Particular embodiments of the body 31 further comprise a plaster ring 88 that provides a water seal when the interior finish 23 is applied in the conventional manner. The fluid flow 33, which is supplied by plumbing connected to a pump included in a cleaning head circuit, forces the nozzle head 4 through the nozzle openings 12, 14. The cross-sectional view of FIG. 4B is taken at a point where only one of the nozzle openings 12 shows in the illustration for clarity in showing the other internal elements of this example of a cleaning head. FIGS. 5 and 6 illustrate multiple nozzle openings 12, 14, 16, 18 in the nozzle heads 2, 6. The nozzle head 4 and the stem 27 are typically positionally coupled such that when one rotates, the other rotates simultaneously as the same rate and in the same direction.

The plate 10 of the nozzle head 4 is shown in FIG. 4A trapped between the top of the stem 27 and the nozzle head 4. In one or more embodiments, the cap ring 53 is removeably coupled to retainer 24 and indexed to a selected relational position. FIG. 4A also depicts a cross section view of a cam assembly 68 for an incrementally rotating cleaning head with a reverser to reverse directions rather than skipping a portion of the 360 rotation quickly. In this particular embodiment, the cam assembly comprises an upper section 61, a lower section 62 and a slidable section 63 (also referred to as a reverser). The cap ring 53 guides the nozzle head 4 and locks the cam assembly 68 in a user-selected aimed position.

The body may further comprise body installation lugs 76 in order to interface or engage with retainer installation lugs 75 for installation of the pool cleaning head assembly. Body installation lugs 76 and retainer installation lugs 75 may be indexably positioned in a desired location so the pool cleaning head assembly can be installed in only one rotatable position within the body 31, ensuring the previously set aim direction is preserved when the pool cleaning head assembly is removed and replaced for service or inspection.

One or more embodiments of a cleaning head assembly further comprise a thrust washer 79 that is slideably engaged with stem 27 and the retainer 24. The thrust washer 79 resists wind-up of spring 72 and reduces friction between the spring 72 and the retainer 24. At least one but typically two cam pins 84 are disposed in or about the nozzle head 4 to engage the cam assembly 68. The spring 72 serves to bias the stem 27 and nozzle head 4 downwardly to a retracted position in the absence of the pressurized flow 33. In this way, the one or more pins 84 will engage the cam assembly 68 to rotate the nozzle head 4 and the stem 27 upon each pressurization and depressurization of pressurized fluid flow 33. A ring seal 80 serves to seal pressurized fluid flow 33 and add tension in the interface of body installation lugs 76 and retainer installation lugs 75 so that fluid flow exits the nozzle head 4 primarily through the nozzle openings 12, 14.

Figure 4C:
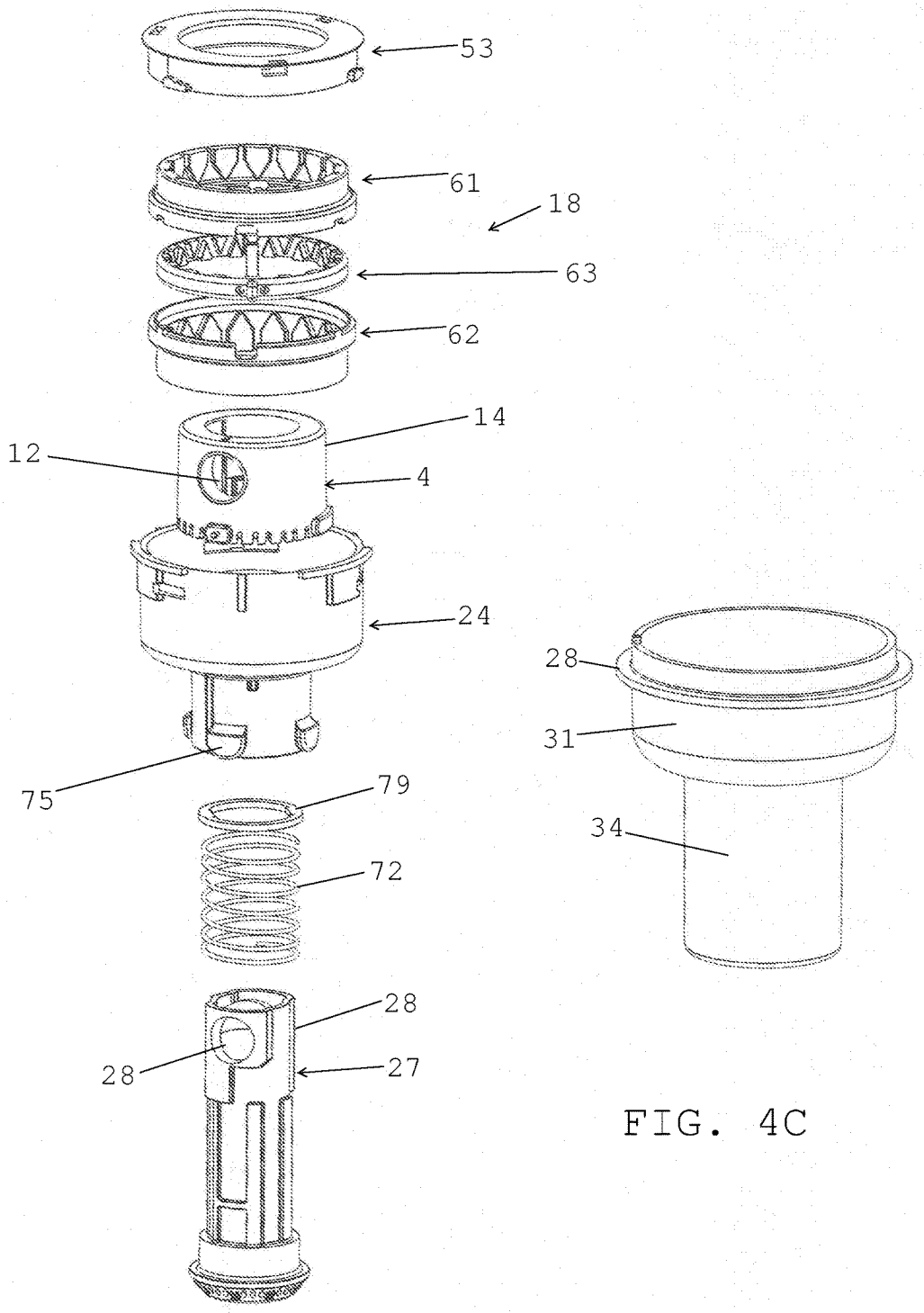
FIG. 4C is an exploded perspective view of a pool cleaning head assembly.

With particular reference to FIG. 4C, an exploded perspective view of the cleaning head assembly of FIG. 4A is provided. As depicted, the cam ring 53 comprises one or more aim lugs extending therefrom and one or more aiming tool ports 85. The stem 27 typically further comprises multiple stem outlets 28 that align with the nozzle openings 12, 14 when the stem is positionally coupled to the nozzle head 4, allowing water to flow through the stem 27, the stem outlets 28, and the nozzle orifices 12, 14.

The cam assembly 68 depicted in FIG. 4C comprises an upper section 61 (also referred to as an upper cam), a lower section 62 (also referred as a lower cam), and a slidable section 63 (also referred to as a reverser). Those of ordinary skill in the art will readily understand the operation and functionality of the reversible nature of this example of a nozzle head from this disclosure and the materials incorporated herein.

FIGS. 5 and 6 illustrate one quarter sectional views of, respectively, a variable rotating nozzle head 4 comprising two nozzle openings 12, 16 (FIG. 5) and four nozzle openings 12, 14, 16, 18 (FIG. 6) providing example through particular configurations having incrementally rotating, reversible cleaning head structures. As described previously, these embodiments could alternatively be configured with continuously or incrementally rotating cleaning head configured to skip a portion of the 360 degree rotation quickly, or a continuously rotating head that includes a reverser. For these examples, each of the nozzle heads 2 are shown in the extended position with respect to the retainer 24 in which they are mounted and are mounted as described with respect to FIGS. 4A-4C. In the particular embodiment of FIG. 5, first and second nozzle openings 12, 16 each point in different directions and is configured as nozzle head 2 in FIGS. 3A and 3B. The first nozzle opening 12 being larger than second nozzle opening 16, and the second nozzle opening 16 being oriented in a direction about 90 degrees from the orientation of the first nozzle opening 12. In the particular embodiment of FIG. 6, first, second, third and fourth nozzle openings 12, 14, 16, 18 each point in different directions and the nozzle is configured as nozzle head 2 in FIGS. 3A and 3B. The first nozzle opening 12 being larger than second nozzle opening 16, and the second nozzle opening 16 being oriented in a direction about 90 degrees from the orientation of the first nozzle opening 12. For the particular nozzle head 4 embodiment of FIGS. 4A-4C, the first nozzle opening 12 and second nozzle opening 14 are roughly the same size and are oriented in a direction about 180 degrees different from each other.

Although three particular embodiments are illustrated in FIGS. 3A-6, each with two, three or four nozzle openings 12, 14, 16, 18 each oriented in a different direction at least 90 degrees different from the orientation of the other nozzle openings so that in the embodiment with four nozzle openings there is 90 degrees between the orientation of each adjacent nozzle opening, there is no requirement that any particular number or size of nozzle openings be used or that there be any particular angle between the directional orientation of adjacent nozzle openings. Those of ordinary skill in the art will readily understand application of the principles taught here to the particular situation or swimming pool surface to be cleaned from this disclosure. Each swimming pool surface to be cleaned has particular characteristics, dimensions, orientations and modifications that may be needed to most effectively clean the particular surface and the examples provided herein are not intended to be limiting or exclude its usefulness toward any particular pool surface or structural condition. Furthermore, each swimming pool cleaning system has its own characteristics and modifications and may require a differently configured cleaning head to best function with that system.

In one variable rotating cleaning head system embodiment, a nozzle head 6 with two large nozzle openings 12, 14 and two small nozzle openings 16, 18 is positioned on a swimming pool step surface 20 and oriented so that the two large nozzle openings 12, 14 are oriented toward the longer portion of the step in relation to the position of the nozzle head 6, and so that the two small nozzle openings 16, 18 are oriented toward the shorter portion of the step in relation to the position of the nozzle head 6. In this orientation with four nozzle openings 12, 14, 16, 18, and in relation specifically to an incrementally rotating cleaning head, rather than the typical about 18 steps of incremental rotation to clean the full 360 degrees around the nozzle head as would be required by a nozzle head with only a single nozzle opening, only 3 to 6 steps of incremental rotation is needed, depending upon the size of the incremental rotations, and in a particular embodiment 5 steps of incremental rotation. This similarly reduces the pump running time from 18 minutes down to 3 to 6 minutes of run time, thus saving time, wear and tear on the pool pump and equipment, and most significantly on energy costs. The principle here is to use larger nozzle openings 12, 14, to clean the areas of the pool steps where more cleaning is needed, and use the smaller nozzle openings 16, 18 to clean the areas between where the larger openings clean. Depending upon the particular configuration of nozzle openings used, this will result in the cleaning head incrementally rotating a predetermined number of steps resulting in a rotation of somewhere between 45 degrees to 180 degrees before it either reverses and incrementally rotates the predetermined number of steps in the opposite direction, or skips ahead on its rotation to a portion of the rotation where the larger openings 12, 14 are again directed toward the wide portion of the swimming pool steps. Although this rotational scheme may involve non-overlapping nozzle section coverage (for example, each nozzle spraying a portion of a pool surface around the cleaning head exactly 90 degrees for four nozzle openings), it may also specifically involve overlapping nozzle section coverage (for example, each nozzle may spray 100 degrees of rotation before skipping or reversing for four nozzle openings so that the overlap assists in cleaning adjacent areas). For a particular swimming pool cleaning circuit, the principle applied could result from any combination of nozzle opening sizes, numbers of nozzles on a particular nozzle head, and degrees of rotation depending upon the capacity of the particular swimming pool cleaning circuit and pump.

Typical nozzle opening sizes include diameters of ¾", ½", ⅜", ¼" and ⅛". A typical cleaning circuit includes one or more nozzle heads in a particular circuit operating simultaneously and separately from the nozzle heads of the other circuits. Conventionally, a circuit could comprise a first nozzle head with a 1¾" diameter nozzle opening to clean a longer step's major area of 10 feet, and a second nozzle head 1¼" diameter nozzle opening to clean a shorter step's minor area of 1 to 2 feet. Alternatively, a conventional circuit could comprise a first nozzle head with a 2½" diameter nozzle opening to clean a longer step major areas of 8 feet each (16 feet). In another configuration, a conventional circuit could comprise nozzle head with a nozzle opening of 2¼" diameter to clean two minor areas of 1 to 2 feet each.

For embodiments of the present disclosure, with a pump system circuit producing 60 gallons per minute and incrementally rotating 60 times per hour, regardless of which particular nozzle head the nozzle opening is included in, the circuit can handle one ¾" diameter nozzle opening, two ½" diameter nozzle openings, four ⅜" diameter nozzle openings, and eight ¼" diameter nozzle openings. The addition of ¼" and ⅛" diameter nozzle openings can be added to circuits with little effect on the cleaning effectiveness of the larger nozzle opening. In a first example from FIG. 3A, a nozzle head 4 may include first and second nozzle openings 12, 14 each having a ½" diameter nozzle openings. The nozzle head 4 is set to incrementally rotate between 8 and 10 steps, and in a particular embodiment 9 steps, giving about 180 degrees of rotation. In a second example from FIG. 3A, a nozzle head 2 may include first and second nozzle openings 12, 16, the first nozzle opening 12 having a ½" diameter opening and the second nozzle opening 16 having a ⅛" diameter opening. The nozzle head 2 is set to incrementally rotate between 13 and 15 steps, and in a particular embodiment 14 steps, giving about 270 degrees of rotation. The first nozzle opening 12 then cleans all of the step on both sides of the nozzle head 2 but leaves the back side of the step closest to the wall for the second, smaller nozzle opening 16 to clean. In a third example from FIG. 3A, a nozzle head 6 may include four nozzle openings 12, 14, 16, 18 the first nozzle opening 12 and the second nozzle opening 14 each having a ½" diameter opening and the third nozzle opening 16 and the fourth nozzle opening 18 each having a ⅛" diameter opening. The nozzle head 6 is set to incrementally rotate between 3 and 6 steps, and in a particular embodiment 5 steps, giving about 90 degrees of rotation. The first and second nozzle openings 12 then clean all of the step on both sides of the nozzle head 6 but leaves the front and back sides of the step for the third and fourth, smaller nozzle openings 16, 18 to clean.

Figure 7:
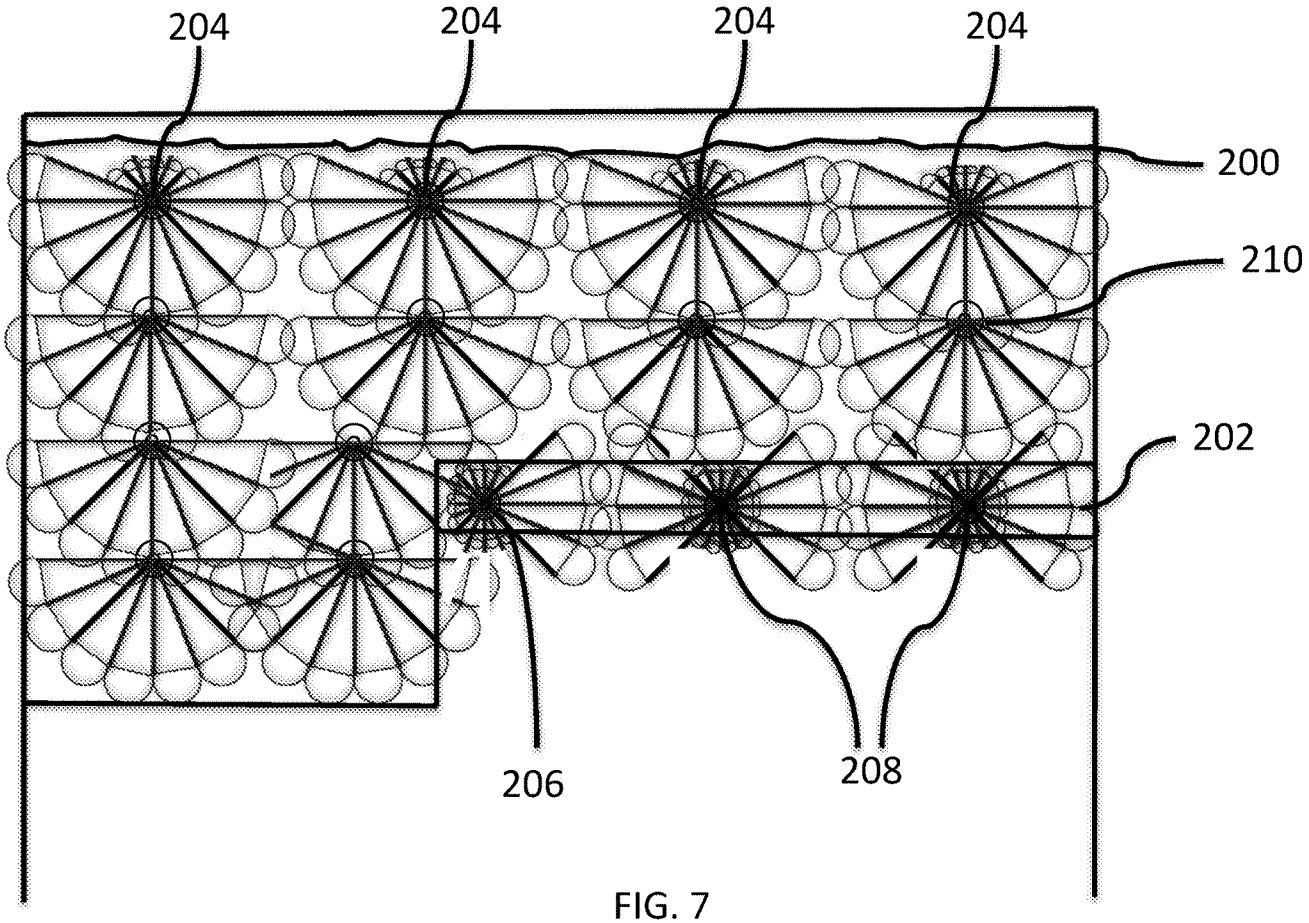
FIG. 7 is a cleaning head layout plan for a portion of a swimming pool employing different types of variable rotating and other cleaning head types.

Similar to previous FIGS. 2B and 2C, FIG. 7 represents the cleaning head spray patterns of a plurality of variable rotating heads with multiple nozzle openings per head applied to several cleaning circuits in a swimming pool. This particular implementation relates to a shallow entry pool where the shallow entry end 200 of the pool gradually gets deeper as the pool extends to the right of the illustration. In this example, the shallow entry then also includes a step 202 that steps down to a deeper end of the pool. The cleaning heads closest to the shallow end 200 of the pool are each variable rotating heads 204 with a large nozzle opening and a small nozzle opening, as illustrated by the spray patterns shown in FIG. 7, and have been aimed so that the large nozzle opening is directed away from the shallow end 200. Each of these variable rotating heads 204 on the first row may be included on a first cleaning circuit. For the cleaning circuit positioned on the stair, variable rotating heads 206, 208 are used. The cleaning head 206 closest to the center of the pool at the left edge of the step is like the cleaning head describe with reference to FIG. 2C, with one large nozzle opening and three small nozzle openings, the nozzle head only rotating 90 degrees in four cycles. The two remaining variable rotating heads 208 on the step 202 each have two large nozzle openings 180 degrees apart, and two small nozzles 180 degrees apart to also clean their corresponding parts of the step in four cycles. Each of these three cleaning heads could be included on the same cleaning circuit. For the rest of the cleaning heads in this example, variable cleaning heads 210 may also be used where only a large nozzle is included. The nozzle sprays to only 180 degrees of its full 360 degrees around it to direct debris toward the deeper end of the pool away from the shallow end 202.

Each in-floor swimming pool cleaning system may be configured differently depending upon the particular needs of the specific pool configuration and the cleaning system type being used. Those of ordinary skill in the art will readily recognize from the disclosures and teachings herein the extent of the application of this disclosure and how to apply the principles to a wide variety of in-floor pool cleaning systems.

It will be understood that implementations are not limited to the specific components disclosed herein, as virtually any components consistent with the intended operation of a method and/or system implementation for a nozzle assembly may be utilized. Accordingly, for example, although particular nozzle assemblies may be disclosed, such components may comprise any shape, size, style, type, model, version, class, grade, measurement, concentration, material, weight, quantity, and/or the like consistent with the intended operation of a method and/or system implementation for a nozzle assembly may be used.

In places where the description above refers to particular implementations of nozzle assemblies, it should be readily apparent that a number of modifications may be made without departing from the spirit thereof and that these implementations may be applied to other nozzle assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A method of cleaning steps of a swimming pool, the method comprising:

intermittently raising a nozzle head positioned on a step of the swimming pool under water, the nozzle head comprising at least a first nozzle opening and a second nozzle opening directed in different first and second nozzle directions toward a surface of the step, and simultaneously ejecting a first stream of water from the first nozzle opening toward a first, longer portion of the step and a second stream of water from the second nozzle opening toward a second, shorter portion of the step different from the first portion;

incrementally rotating the nozzle head in a first rotational direction;

retracting the nozzle head flush with an inner surface of the swimming pool; and incrementally rotating the nozzle head in a second rotational direction, opposite the first rotational direction, after the nozzle head rotates a predetermined number of incremental rotations in the first rotational direction and at least 45 degrees but not more than 180 degrees.

2. The method of claim 1, wherein the first nozzle direction and the second nozzle direction are at least 90 degrees different from each other.

3. The method of claim 2, wherein the nozzle head incrementally rotates between 13 to 15 times in the first rotational direction prior to incrementally rotating in the second rotational direction.

4. The method of claim 2, wherein the nozzle head further comprises a third nozzle opening directed in a third direction, different from the first direction and the second direction by at least 90 degrees, wherein the nozzle head incrementally rotates between 3 to 6 times in the first rotational direction prior to incrementally rotating in the second rotational direction.

5. The method of claim 2, wherein the nozzle head further comprises a third nozzle opening directed in a third direction, different from the first direction and the second direction by at least 90 degrees, and at fourth nozzle opening directed in a fourth direction, different from the first direction, and the second direction and the third direction by up to 90 degrees each, wherein the nozzle head incrementally rotates between 3 to 6 times in the first rotational direction prior to incrementally rotating in the second rotational direction.

6. The method of claim 2, wherein the nozzle head incrementally rotates between 8 to 10 times in the first rotational direction prior to incrementally rotating in the second rotational direction.

7. A method of cleaning a swimming pool, the method comprising:

aiming an adjustable swimming pool cleaning nozzle head in a swimming pool with at least a first large nozzle opening facing in a first direction and at least a first small nozzle, smaller than the first large nozzle, facing in a second direction different from the first direction;

raising the nozzle head under water in the swimming pool and simultaneously ejecting at least a first large stream of water in the first direction from the first nozzle opening and at least a first small stream of water, smaller than the first large stream of water, from the first small nozzle opening;

rotating the nozzle head in a first rotational direction; and spraying the first large stream of water toward a first large area of a swimming pool along a width of a pool step and simultaneously spraying the first small stream of water toward a first small area of the swimming pool along a depth of the pool step.

8. The method of claim 7, further comprising simultaneously ejecting at least a second large stream of water in a third direction from a third nozzle opening in the nozzle head, the third direction different from the first direction and the second direction.

9. The method of claim 8, further comprising simultaneously ejecting at least a second small stream of water in a fourth direction from a fourth nozzle opening in the nozzle head, the fourth direction different from the first direction, the second direction and the third direction.

10. The method of claim 9, wherein the first direction, the second direction, the third direction and the fourth direction are each 90 degrees different from each other.

11. The method of claim 8, wherein the first direction and the third direction are 180 degrees different from each other and the first direction and the second direction are 90 degrees different from each other.

12. The method of claim 7, wherein the first direction and the second direction are 90 degrees different from each other.

13. The method of claim 7, wherein the first direction and the second direction are 180 degrees different from each other.

14. A method of cleaning a swimming pool, the method comprising:

intermittently raising a nozzle head under water, the nozzle head comprising at least a first nozzle opening and a second nozzle opening directed in different first and second directions, and simultaneously ejecting a first stream of water outward from the first nozzle opening along a width of a pool step and a second stream of water outward from the second nozzle opening along a depth of the pool step;

incrementally rotating the nozzle head in a first direction;

retracting the nozzle head flush with an inner surface of the swimming pool; and incrementally rotating the nozzle head in a second rotational direction, opposite the first rotational direction, for a predetermined number of incremental rotations, after the nozzle head rotates the predetermined number of incremental rotations in the first rotational direction.

15. The method of claim 14, wherein the first and second directions are at least 90 degrees different from each other and the method further comprises incrementally rotating the nozzle head between 3 to 15 incremental rotations in the first rotational direction prior to incrementally rotating the nozzle head between 3 to 15 incremental rotations in the second rotational direction.

16. The method of claim 15, the nozzle head further comprising at least a third nozzle opening directed in a third direction different from the first and second directions by at least 90 degrees, the method further comprising simultaneously ejecting a third stream of water from the third nozzle opening while the first and second stream of water are being ejected, and incrementally rotating the nozzle head between 3 to 10 incremental rotations in the first rotational direction prior to incrementally rotating the nozzle head between 3 to 10 incremental rotations in the second rotational direction.

17. The method of claim 16, the nozzle head further comprising at least a fourth nozzle opening directed in a fourth direction different from each of the first, second and third directions by up to 90 degrees, the method further comprising simultaneously ejecting a fourth stream of water from the fourth nozzle opening while the first, second and third streams of water are being ejected, and incrementally rotating the nozzle head between 3 to 6 incremental rotations in the first rotational direction prior to incrementally rotating the nozzle head between 3 to 6 incremental rotations in the second rotational direction.

18. The method of claim 17, wherein the first and third nozzle openings are larger in diameter than the second and forth nozzle openings.

19. The method of claim 14, wherein the first direction and the second direction are between 45 degrees and 180 degrees different from each other.

* * * * *